US006065661A

United States Patent [19]

Kunreuther et al.

[11] Patent Number: 6,065,661

[45] Date of Patent: May 23, 2000

[54] AUTOMATIC LOOP FORMING TAG ATTACHER APPARATUS AND METHOD

[76] Inventors: Steven J. Kunreuther, 285 Central Park West, New York, N.Y. 10024; Ronald L. Meyers, 4174 Plainfeld Rd., Sophia, N.C. 27350

[21] Appl. No.: 09/084,268

[22] Filed: May 26, 1998

[51] Int. Cl.[7] ..... B25C 1/00

[52] U.S. Cl. ..... 227/67; 227/30; 227/68

[58] Field of Search ..... 227/67, 68, 71, 227/18, 145, 43, 74, 30; 12/142 LC, 113; 24/704.2

[56] References Cited

U.S. PATENT DOCUMENTS

| | | | |
|---|---|---|---|
| D. 214,122 | 5/1969 | Merser | D8/388 |
| 214,151 | 5/1969 | Merser | 24/704.2 |
| D. 214,152 | 5/1969 | Merser | D8/388 |
| D. 214,153 | 5/1969 | Merser | 24/704.2 |
| 3,733,657 | 5/1973 | Lankton | 206/343 |
| 3,735,908 | 5/1973 | Kinney et al. | 227/67 |
| 3,931,667 | 1/1976 | Merser et al. | 24/704.2 |
| 3,979,799 | 9/1976 | Merser et al. | 24/704.2 |
| 4,183,119 | 1/1980 | Stewart et al. | 24/16 PB |
| 4,288,017 | 9/1981 | Russell | 227/67 |
| 4,482,087 | 11/1984 | Furutsu | 227/67 |
| 4,781,318 | 11/1988 | Meyers | 227/67 |

*Primary Examiner*—Peter Vo
*Assistant Examiner*—Jim Calve
*Attorney, Agent, or Firm*—James & Franklin, LLP; Robert L. Epstein; Harold James

[57] ABSTRACT

Standard tag attaching fasteners in continuous strip form are intermittently moved toward an attacher along a guide track which gradually changes shape from planar to semicircular. The T-bars are feed to the attacher, which is mounted upright on a base. At the same time, each paddle, in turn, having traveled along the guide, is oriented in a plane perpendicular to the axis of the needle, at a location in alignment with but spaced from the needle. A tag or hook, previously removed from a stack by a moveable arm with a vacuum head, is in place over the needle. A portion of the article is situated between the needle and the fastener filament, with the needle in an opening or recess of the article. Upon actuation of the apparatus, the paddle is clamped in position and driven toward the needle such that the paddle is penetrated by the needle. The attacher then ejects the T-bar which lodges on the far side of the paddle, securing the ends of the fastener together to form a closed loop around the article. The article with the tag or hook bearing fastener looped around it is removed by the operator. The next tag or hook is then placed on the needle, as the T-bar and paddle of the next fastener are moved into position.

20 Claims, 11 Drawing Sheets

AUTOMATIC LOOP FORMING TAG ATTACHER APPARATUS AND METHOD

The present invention relates to tag and/or hook attaching apparatus and more particularly to an apparatus and method for forming a standard plastic tag fastener into a closed loop and affixing same, along with a tag or hook or both, on an article, in completely automated fashion.

Various industries require that tags and/or hooks be attached to merchandise prior to sale. For instance, in the hangbag and luggage industry, millions of handles are routinely provided with tags which contain information concerning pricing, inventory control and the like. Other types of articles, such as socks, require plastic hooks to be affixed to permit same to be displayed on racks. Because of the great quantity of articles which must have tags or hooks affixed to them, it is necessary that the attaching operation be performed as quickly and inexpensively as possible. Further, the tag or hook must be affixed to the article in such a manner that theft through tag switching and accidental dislodgement of the tag or hook are minimized.

If an article is made of fabric or other soft material which permits it to be penetrated by a needle without damage, standard hand-held and powered tag attaching equipment can be utilized. Such commercially available attaching equipment includes a hand-held or base mounted attacher or gun, into which multiple plastic tag attachments or fasteners are fed, either in clip or continuous strip form. Each of the fasteners is injection molded and includes a T-bar at one end and an enlarged solid paddle at the other end. The T-bar and paddle are connected by a relatively thin and flexible, but incredibly strong, stretched plastic filament. Actuation of the attacher causes the T-bar of the fastener to be pushed through a hollow needle. Prior to actuation, tag or hook is placed on the needle and the needle is caused to penetrate the article. When the attacher is actuated, the T-bar of the fastener travels through a channel in the needle and is lodged on the far side of the article, while the paddle remains on the side facing the attacher.

This system provides a low-cost tag or hook attaching operation. A minimum of unskilled labor is required. The cost of the plastic fasteners, of the tags or hooks and of the attachers themselves is relatively small. Further, the attachment operation is accomplished within a few seconds. Security is assured with this type of fastener because it is made of strong plastic which prevents the tag or hook from being removed, except by destruction of the article, or by cutting the filament of the fastener.

Fasteners and attachers of this type are commercially available from Dennison Manufacturing Company of Framingham, Mass. and other suppliers. They are widely used throughout this country and many other countries of the world. The hand-held attachers are basically gun-shaped and may either be of the pistol grip type or the scissor grip type. One example of an attacher which uses strip or "continuous" ladder type connected fasteners is known as Dennison System 1000 and is depicted in Russell U.S. Pat. No. 4,288,017 of Sept. 8, 1981. A clip of parallel spaced fasteners and a scissor grip type attacher are illustrated in Lankton U.S. Pat. No. 3,733,657 of May 22, 1973. A pistol grip type attacher is illustrated in Furutsu, U.S. Pat. No. 4,482,087 of Nov. 13, 1994.

Attachers of this type are primarily designed for hand-held use and the great majority of attachers utilized today are used in this manner. However, because of the very large number of attaching operations which take place on a daily basis in certain manufacturing or marking locations, the desirability of automating the attaching process is obvious. A variety of power or pneumatically driven devices have been developed for this purpose. For example, Kinney in U.S. Pat. No. 3,735,908 discloses a pneumatically driven attacher which can be hand held or mounted on a support. However, this device requires that the tags be manually fed and cannot form the fasteners into loops.

There have also been a limited number of attempts to design equipment which could be used in conjunction with conventional attachers to automate the tag attaching operation. However, only the automatic tag attaching equipment of the type disclosed in U.S. Pat. No. 4,235,161 entitled "AUTOMATIC TAG ATTACHING APPARATUS issued to Steven Kunreuther on Nov. 25, 1980, (known as the MAT® machine) has proven commercially acceptable.

Other automatic equipment is disclosed in U.S. Pat. No. 4,237,779 entitled "Automatic Attaching Apparatus" issued to Steven Kunreuther on Dec. 9, 1980, U.S. Pat. No. 4,589,583 entitled "Automatic Hook Attaching Apparatus" issued to Steven Kunreuther and John T. Roberts on May 20, 1986 and U.S. Pat. No. 4,889,272 entitled "Automatic Apparatus For Attaching Tags to Labels Previously Affixed to Garments" issued to Steven Kunreuther on Dec. 26, 1989.

None of this attaching equipment, whether manual or power driven, is capable of automatically forming a standard fastener into a loop and affixing the looped fastener, along with a tag or hook, around a portion of an article. We are aware of fasteners known as "security loops" which are widely used when a manually applied looped fastener is required. They are illustrated in Merser U.S. Pat. No. 3,931,667 and Merser U.S. Pat. No. 3,979,799. Another type of manually applied loop type fastener in use is illustrated in Merser U.S. Design Patent Nos. 214,122; 214,151; 214,152; and 214,153 and is available from Dennison Manufacturing Co. of Framingham, Mass. under the trademark SECUR-A-TIE®. However, these fasteners can be applied manually only. There exists no known equipment capable of applying these fasteners automatically.

Instead of attempting to develop automated attaching equipment for use with "security loop" or SECUR-A-TIE® type fasteners, we have decided to harness the already perfected technology of the standard plastic tag fastener and attacher in unique way to provide attaching equipment which is capable of automatic application of a fastener by forming the fastener into a loop and positioning the looped fastener, with a tag or hook, around an article. Using standard fasteners and commercially available attachers greatly reduces the development and fabrication costs. Moreover, since standard fasteners are so inexpensive and so widely known and used throughout the world, conversion to the automated equipment of the invention is facilitated because it is simple to understand and already familiar.

The use of standard fasteners and attachers is possible in our invention because the paddle end of the fastener is itself used to receive and retain the T-bar end of the fastener to form the loop. In order to accomplish this, the hollow needle, which dispenses the T-bar, must penetrate the solid paddle prior to actuation of the attacher to eject the T-bar. By causing the fastener to travel along a uniquely shaped guide track, the paddle is oriented and situated in a position spaced from, but in alignment with the front of the needle. With the article in place, and a tag or hook already on the needle, the paddle is clamped in position and driven toward the needle such that the needle penetrates the paddle. Actuating the attacher secures the loop by causing the T-bar of the fastener to travel down the needle and lodge on the far side of the paddle. The article is then removed from the device, with the fastener carrying the tag or hook looped securely around it.

It is, therefore, a prime object of the present invention to provide apparatus which automatically securing a looped standard fastener around a portion of an article.

It is another object of the present invention to provide an automatic loop forming tag attacher apparatus which automatically attaches a looped standard fastener with a tag and/or hook around a portion of an article.

It is another object of the present invention to provide an automatic loop forming tag attacher apparatus which uses a commercially available tag fastener attacher.

It is another object of the present invention to provide an automatic loop forming tag attacher apparatus which utilizes standard commercially available tag fasteners with solid paddles.

It is another object of the present invention to provide an automatic loop forming tag attacher method in which articles are quickly, easily and safely tagged or provided with hooks utilizing a standard fastener, formed into a loop.

In accordance with one aspect of the present invention, automatic apparatus is provided for attaching a fastener around a portion of an article. The fastener is of the type having a "T" bar end and a paddle end connected by a flexible filament. The apparatus includes a fastener attacher having a hollow needle which is adapted, when actuated, to dispense the "T" bar end of a fastener through the needle. Means are provided for feeding the fastener to provide the "T" bar end to the attacher and to position the paddle end in alignment with, but spaced from the needle. Means are provided for driving the paddle toward the needle such that the paddle is penetrated by the needle. Means are also provided for actuating the attacher to dispense the T-bar end such that it lodges on the side of the paddle end, closing the loop.

Guide means are provided as part of the fastener feed means. The guide means comprises a track with a cross-sectional configuration which gradually changes from planar to semicircular. A pneumatically driven claw engages the fasteners and moves them along the guide means.

Means are provided for retaining the paddle in the spaced position. The retaining means has a recess adapted to receive a paddle end. Means are provided to clamp the paddle end within the recess. The clamping means includes an arm which defines an opening aligned with the needle. The clamping means is bifurcated, having first and second parts which define the opening.

The needle has an axis. The paddle end is clamped in a plane substantially perpendicular to the needle axis. The drive means moves the paddle end toward the needle, in the direction of the needle axis. The paddle end is substantially solid, prior to being penetrated by the needle.

The apparatus is adapted for use with an article having an opening or a recess defined by a portion. The portion of the article is situated between the needle and the filament, prior to actuation of the drive means.

Means are provided to feed a tag or hook onto the needle. This means is also actuated prior to actuation of the drive means.

The apparatus is adapted for use with a continuous strip of fasteners. The fastener feed means includes a claw which moves the strip along the guide means toward the attacher.

In accordance with another aspect of the present invention, a method is provided for forming a loop around an article with a fastener of the type having a "T" bar end and a paddle end connected by a flexible filament. A fastener attacher having a hollow needle is adapted when actuated to dispense the "T" bar end of the fastener through the needle. The method comprises the steps of feeding a fastener to provide the "T" bar end to the attacher and the paddle end to a position in alignment with, but spaced from, the needle. A portion of the article is placed between the needle and the filament. The paddle end is driven towards the needle such that it is penetrated by the needle. The attacher is actuated to dispense the T-bar end such that it lodges on the side of the paddle end, closing the loop around the article.

The method further comprises the step of feeding a tag or hook onto the needle. This is done prior to actuation of the paddle driver. The method is adapted for use with a continuous strip of fasteners. The step of feeding the fastener comprises the step of moving the strip of fasteners along a guide track to situate the paddle end in the spaced position.

The needle has an axis. The method further comprises the step of clamping the paddle end in position in a plane substantially perpendicular to the needle axis. The step of clamping the paddle comprises the step of pivoting a clamping arm. The clamping arm is pivoted prior to driving the paddle end toward the needle.

To these and to such other objects which may hereinafter appear, the present invention relates to an automatic loop forming tag attacher apparatus and method as described in detail in the following specification and recited in the annexed claims, taken together with the accompanying drawings, wherein like numerals refer to like parts and in which:

Figure 1:
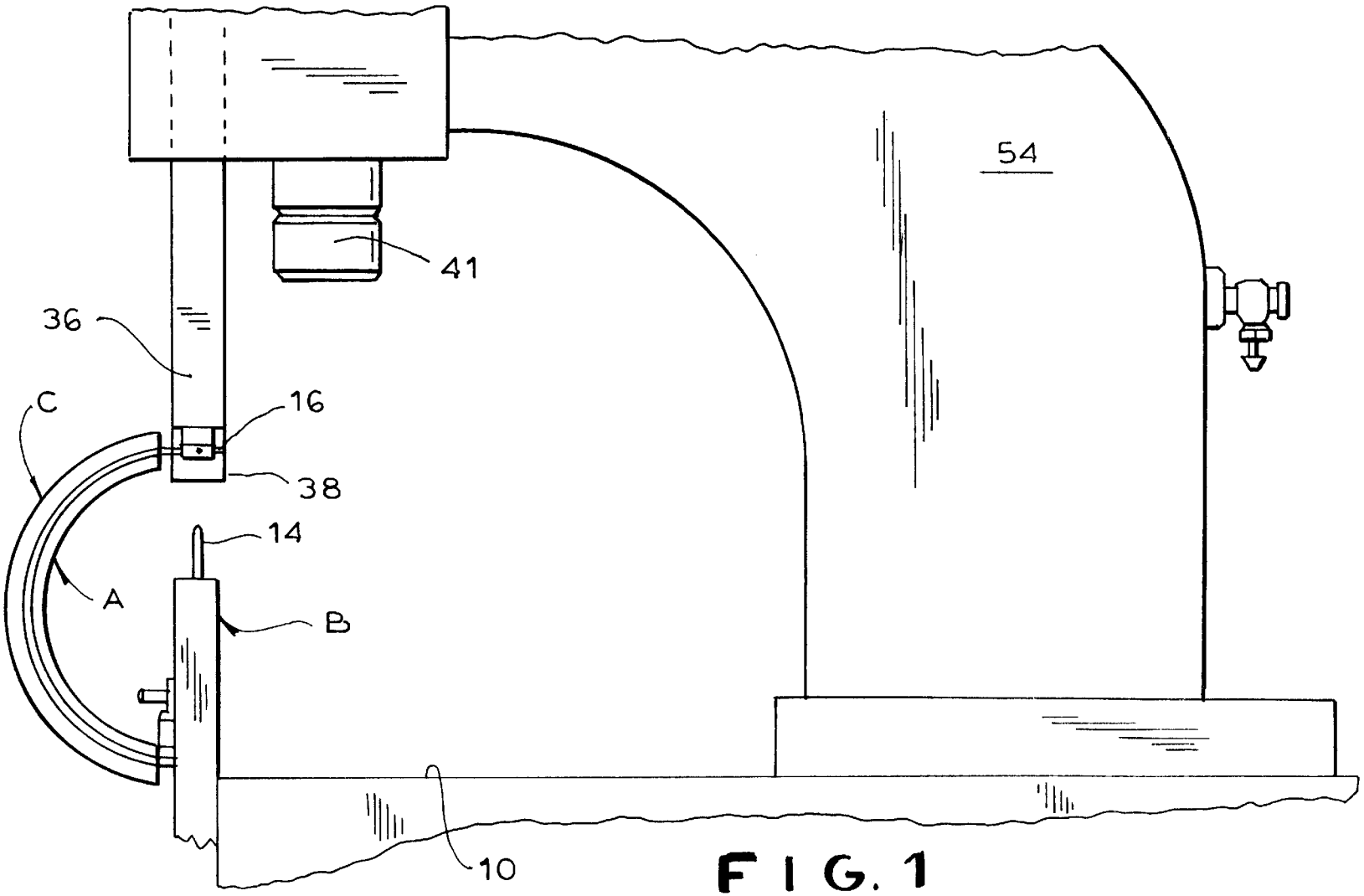
FIG. 1 is a front elevational view of the apparatus of the present invention.

As seen in the drawings, the apparatus of the present invention is a pneumatically operated automatic tag or hook attaching system which takes standard, commercially available plastic tag attaching fasteners, generally designated A, in continuous strip form and forms each fastener, one at a time, into a loop. The looped fastener, along with a tag or hook, is secured around a portion of an article which in part defines an opening or recess in the article. The apparatus employs a commercially available Dennison System 1000 Industrial Attacher (or any other comparable pneumatically operated device), generally designated B. The fasteners A are supplied to attacher B along a guide track or plow, generally designated C, by a moving mechanism, generally designated D, such that the T-bar end of each fastener is provided to attacher B and the paddle end of each fastener is situated in a position spaced from the attacher needle. The paddle end is retained in position by a clamping mechanism, generally designated E. Tags or hooks, generally designated G, are positioned on the needle by a feed mechanism, generally designated F. The paddle end of the fastener is driven toward the needle such that the needle penetrates the paddle end, by pneumatic drive means.

Figure 1A:
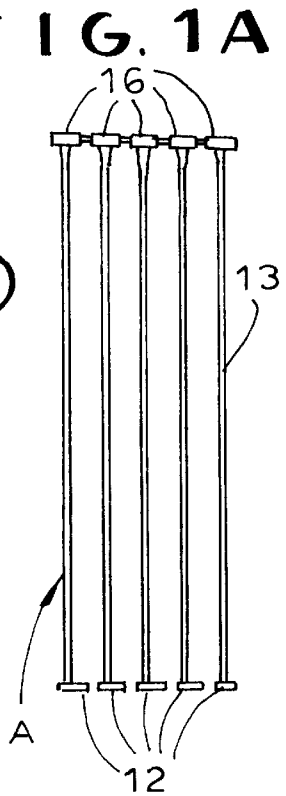
FIG. 1A is an elevational view of a portion of a clip of fasteners.
Figure 2:
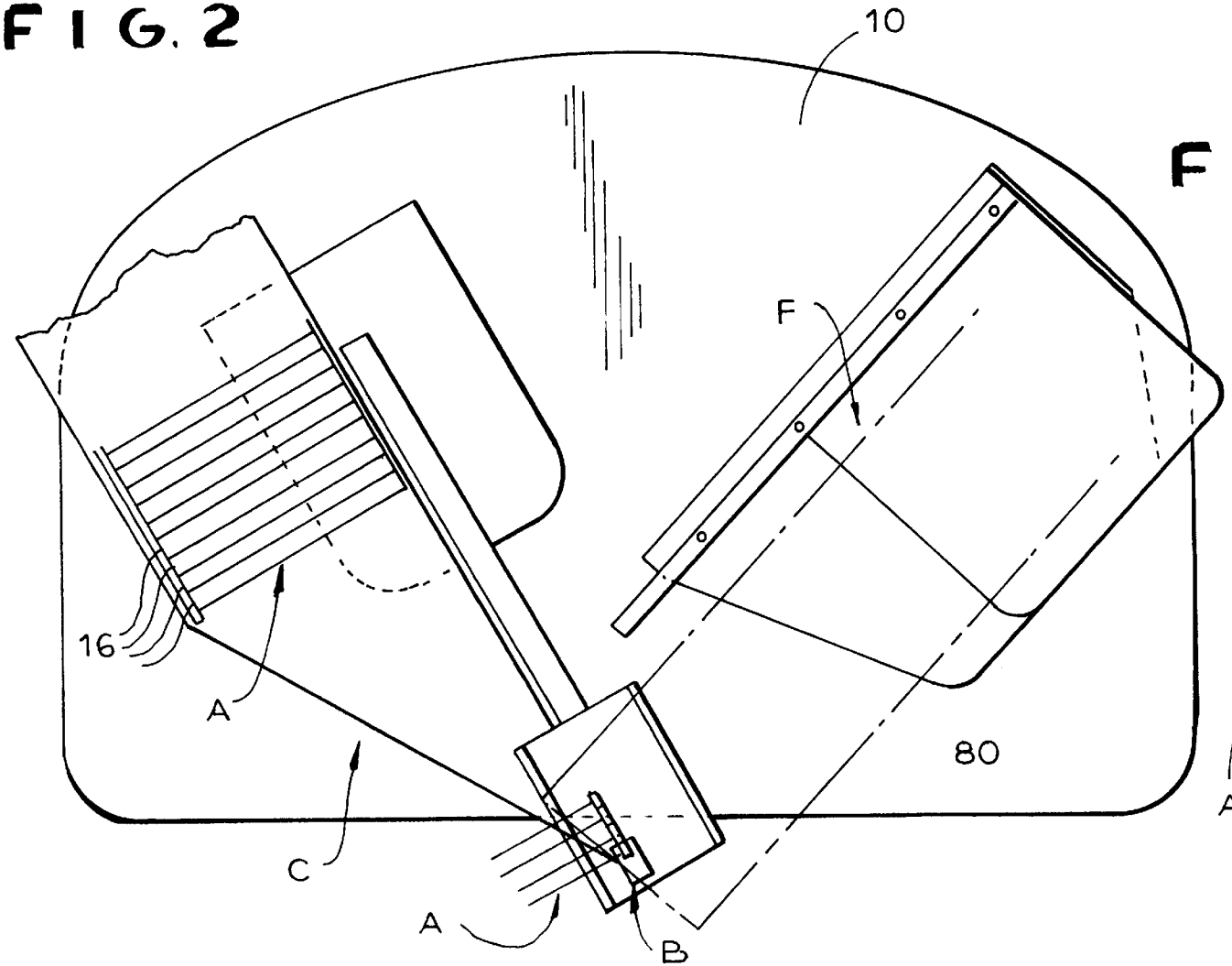
FIG. 2 is a top elevational view of the apparatus showing the placement of the various components.

As seen in FIGS. 1, 1A, 2 and 2A, the apparatus consists of a table top surface 10 to which attacher B is mounted in an upstanding position. Attacher B is pneumatically actuated by a conventional pneumatic cylinder (not shown). As seen in FIG. 1A, each fastener includes a T-bar end 12 and a paddle end 16 connected by a thin flexible filement 13. Paddle ends 16 are solid plastic. When actuated by a pneumatic cylinder, the attacher ejects the "T" bar end 12 of a fastener A through a hollow needle 14. When the cylinder is deactuated, the "T" bar end 12 of the next fastener A is authomatically fed into position to be ejected.

Fasteners A are fed to attacher B along guide track C. The shape of track C can best be appreciated by a comparison of FIGS. 3, 4, 5 and 6.

Figure 2A:
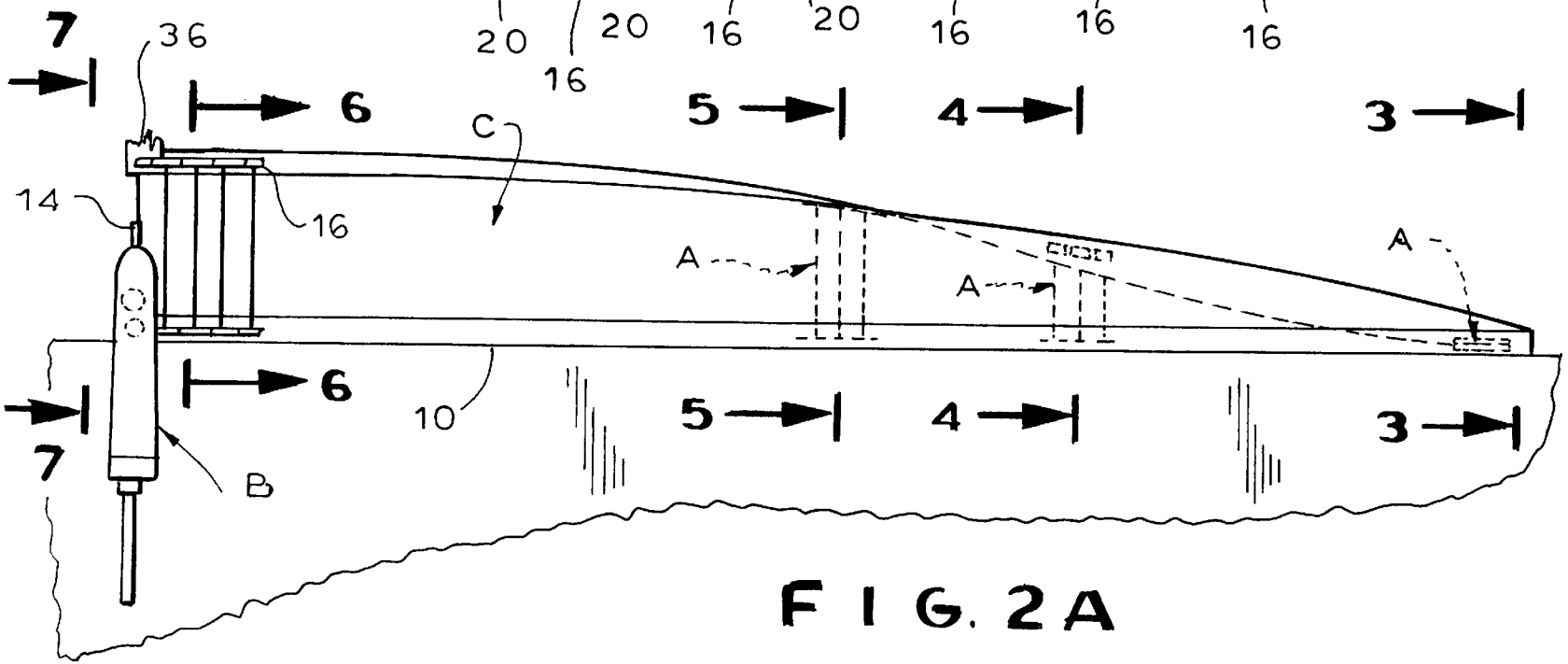
FIG. 2A is a side elevational view of the apparatus showing the guide track.
Figures 3, 4, 5, 6:
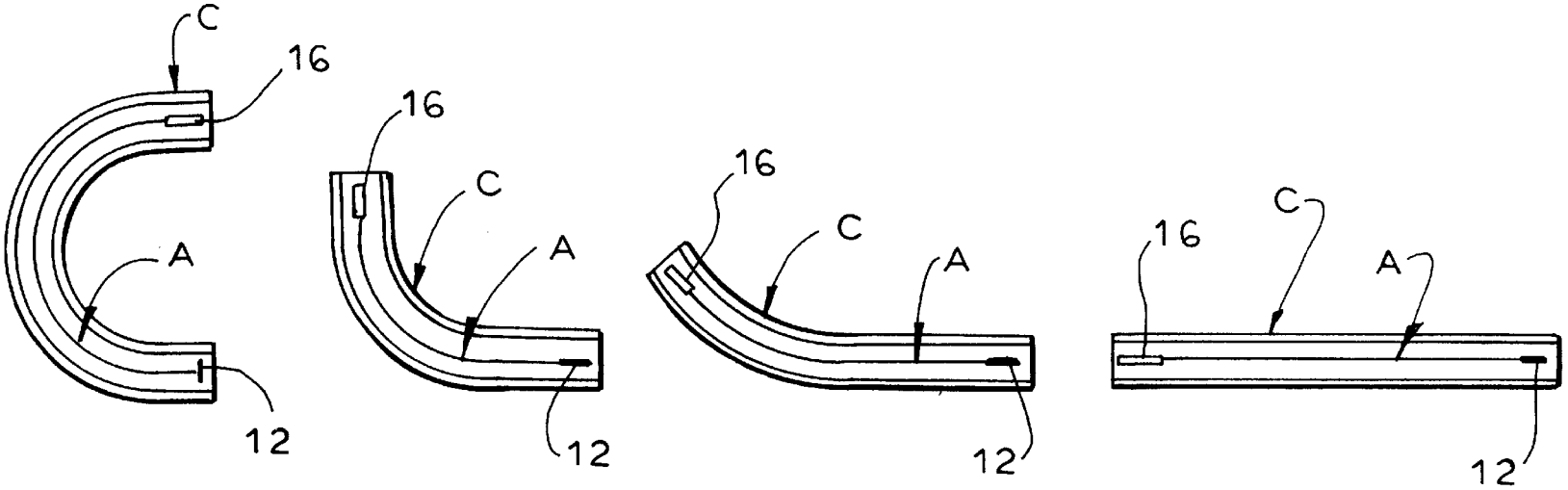
FIG. 3 is a cross-sectional view of the guide track, taken along line 3—3 of FIG. 2A.
FIG. 4 is a cross-sectional view of the guide track, taken along line 4—4 of FIG. 2A.
FIG. 5 is a cross-sectional view of the guide track, taken along line 5—5 of FIG. 2A.
FIG. 6 is a cross-sectional view of the guide track, taken along line 6—6 of FIG. 2A.

At the entrance side (right as seen in FIG. 2A) of the track, as shown in FIG. 3, the track is substantially planar, with the "T" bar end 12, filament 13 and paddle end 16 of the fastener situated in the same plane. This is the way the fastners A come off the roll on which they are supplied. The fasteners are connected side to side in a continuous strip by breakable bridge elements, as is conventional, as illustrated in FIG. 1A.

As the fasteners move along track C toward attacher B, the portion of the track which holds the paddles 16 gradually bends until the track forms a "C" at the end adjacent the attacher (FIG. 6). At that point, the paddle end 16 is oriented in a plane perpendicular to the axis of the needle of the attacher. The "T" bar end of the fastener is rotated ninety degrees by the attacher mechanism. Thus, the lead fastener is positioned such that the axis of the "T" bar end is now aligned with the axis of needle 14 and paddle end 16 is oriented to be perpendicular to the needle axis.

Figure 11:
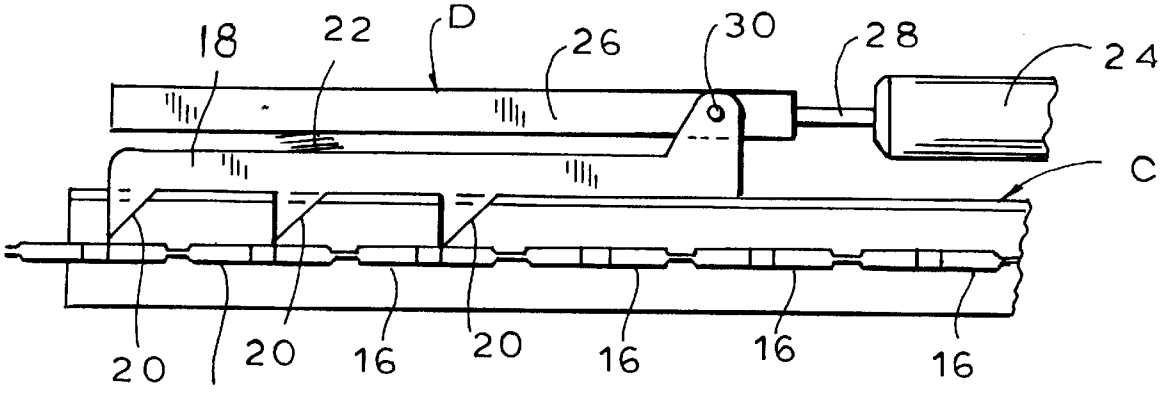
FIG. 11 is a side view of a portion of the guide track, showing the claw which moves the fastener strip.

Fasteners A are intermittently moved along track C by a pneumatically operated moving mechanism D consisting of a claw 18, as seen in FIG. 11. Claw 18 has three downwardly directed triangular teeth 20, the points of which are urged by a spring 22 toward the surfaces of three consecutive paddle ends 16 to engage same. The fasteners are moved by claw 18 toward attacher B, the width of one fastener, each time a pneumatic cylinder 24 is actuated. Claw 18 is pivotally mounted on arm 26 by pin 30. Arm 26 is connected to the piston rod 28 of cylinder 24. Teeth 20 are shaped to engaged paddle ends 16 when the claw is moved toward the attacher by extension of rod 28 but to disengaged the paddle ends as the claw is moved in the opposite direction, to allow movement of the claw relative to the fasteners, as rod 28 is retracted. This is facilitated by the pivoting of arm 26 about pin 30, against the urging of spring 22.

Figure 7:
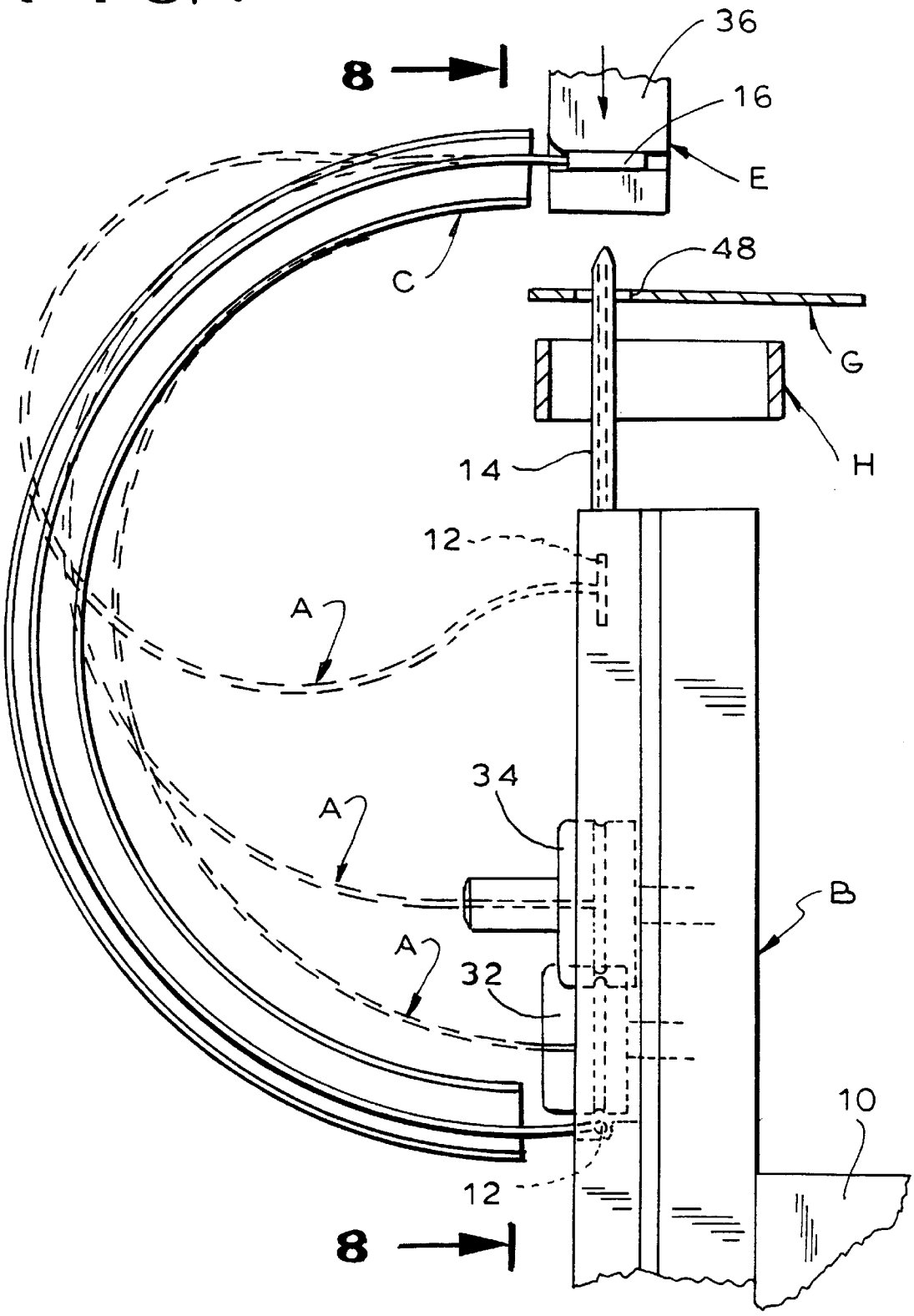
FIG. 7 is an enlarged view of a portion of the attacher, as it appears prior to actuation.
Figure 8:
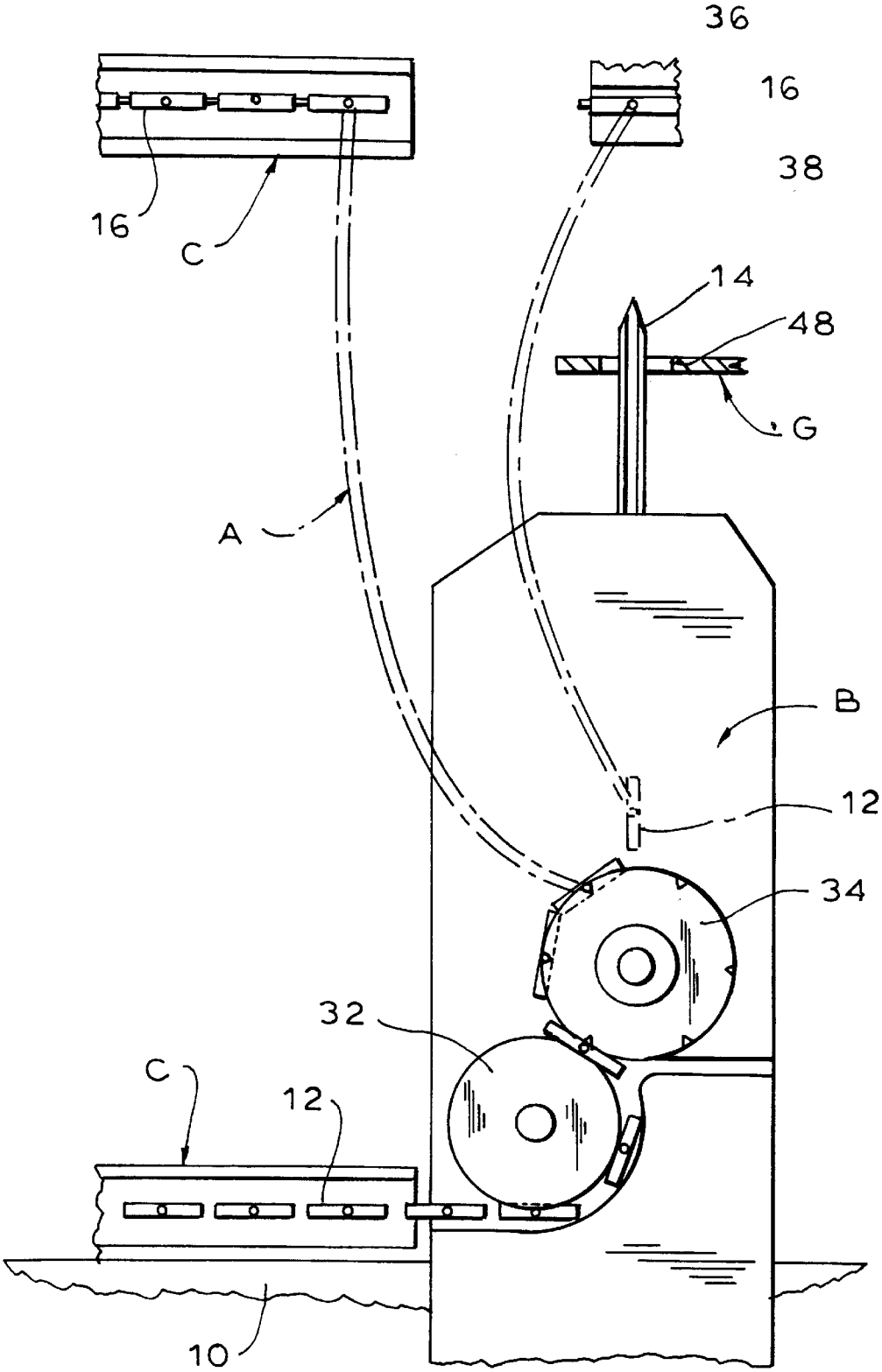
FIG. 8 is a side view of the attacher, taken along line 8—8 of FIG. 7.

Referring now to FIGS. 7 and 8, attacher B, mounted on table 10, receives the "T" bar ends 12 of the fasteners, one at a time, into an "S" shaped channel. The channel is defined by two notched feed wheels 32, 34 which cause the "T" bar ends to rotate ninety degrees from a horizontal to a vertical position, so as to align with needle 14.

Figure 9:
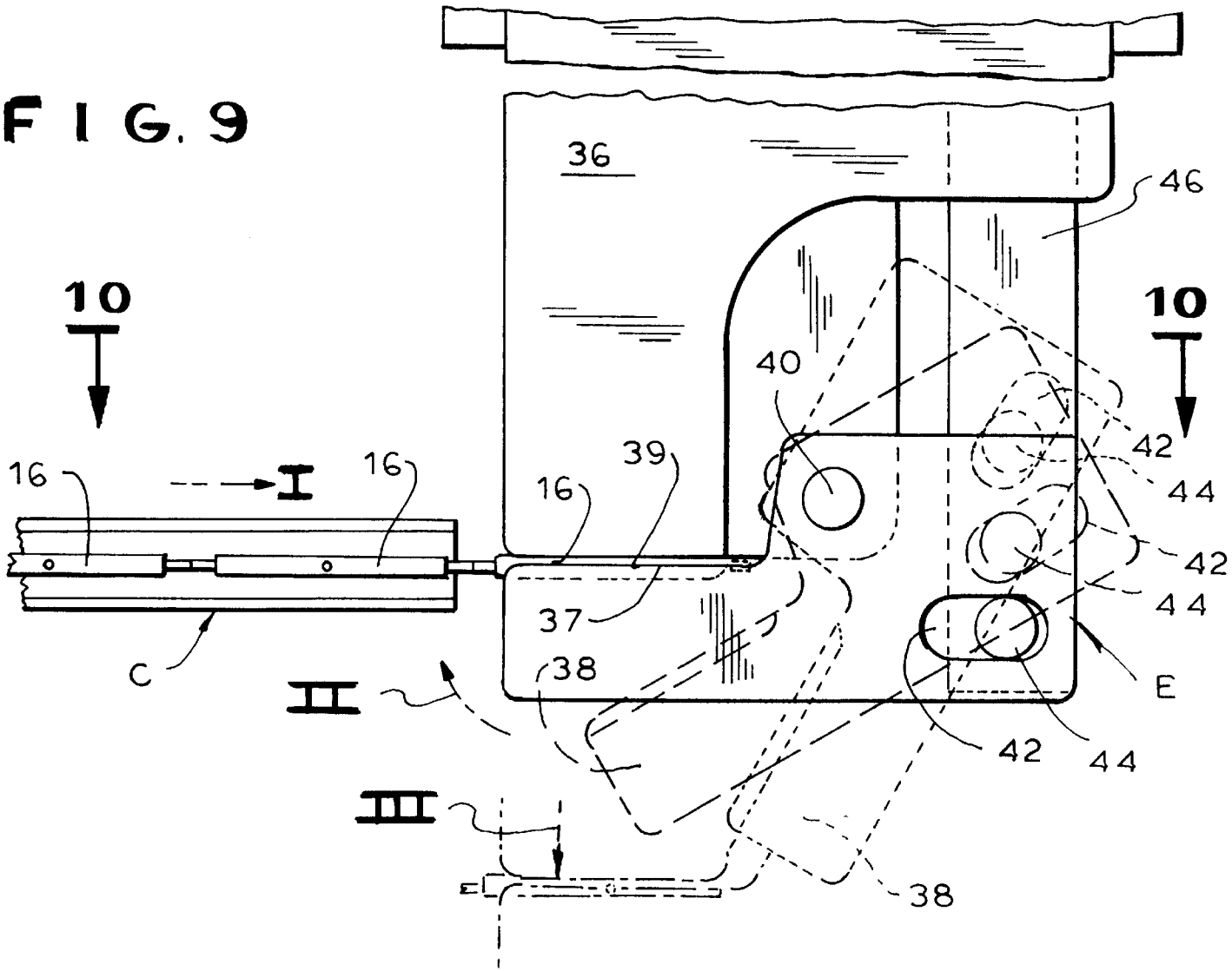
FIG. 9 is an enlarged side view of the end of the guide track and the clamp arm.
Figure 10:
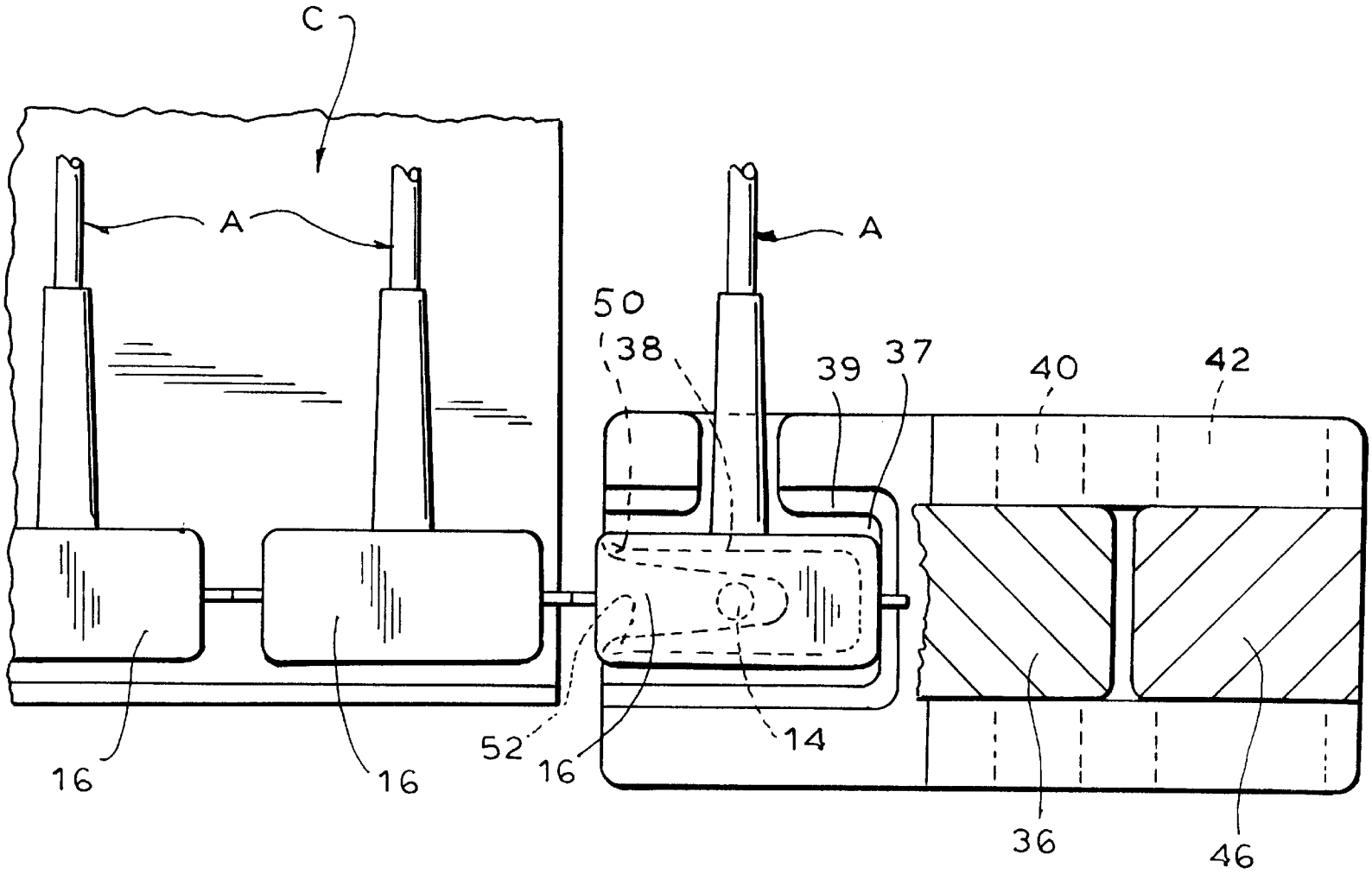
FIG. 10 is a top view taken along line 10—10 of FIG. 9.

As seen in FIGS. 9 and 10, as the leading paddle end 16 is being moved out of the end of track C, it is received within a recess 37 in a retainer 39, located below an anvil 36. Once the paddle end 16 is situated in recess 37, mechanism E is actuated to clamp the paddle end to the anvil. Mechanism E consists of an arm 38 pivotally mounted on anvil 36 by a pin 40. Each side of arm 38 is provided with an elongated slot 42 within which is received a pin 44 mounted on piston rod 46. Rod 46 extends from a two way pneumatic cylinder 41 (a part of which is visible in FIG. 1) mounted proximate anvil 36. Rod 46 is normally in the retracted position, such that arm 38 is in its position closest to the vertical, as seen in phantom in FIG. 9. Actuation of the cylinder causes the rod to extend, moving arm 38 towards its horizontal position, shown in solid in FIG. 9, to clamp paddle end 16 within retainer 39 and hence to anvil 36.

FIG. 10 shows a top view of arm 38. Arm 38 has a bifurcated portion consisting of parts 50, 52 defining an opening aligned with needle 14 of attacher B. This recess permits needle 14 to penetrate the paddle end 16 without interference from the clamp arm but still permits the clamp to adequately support the paddle end throughout the process.

As seen in FIG. 1, anvil 36 and pneumatic cylinder 41 are positioned above attacher B by a support 54. Support 54 is affixed to table top 10 at a point spaced from attacher B and configured to permit the operator as much work room as possible.

Figure 12:
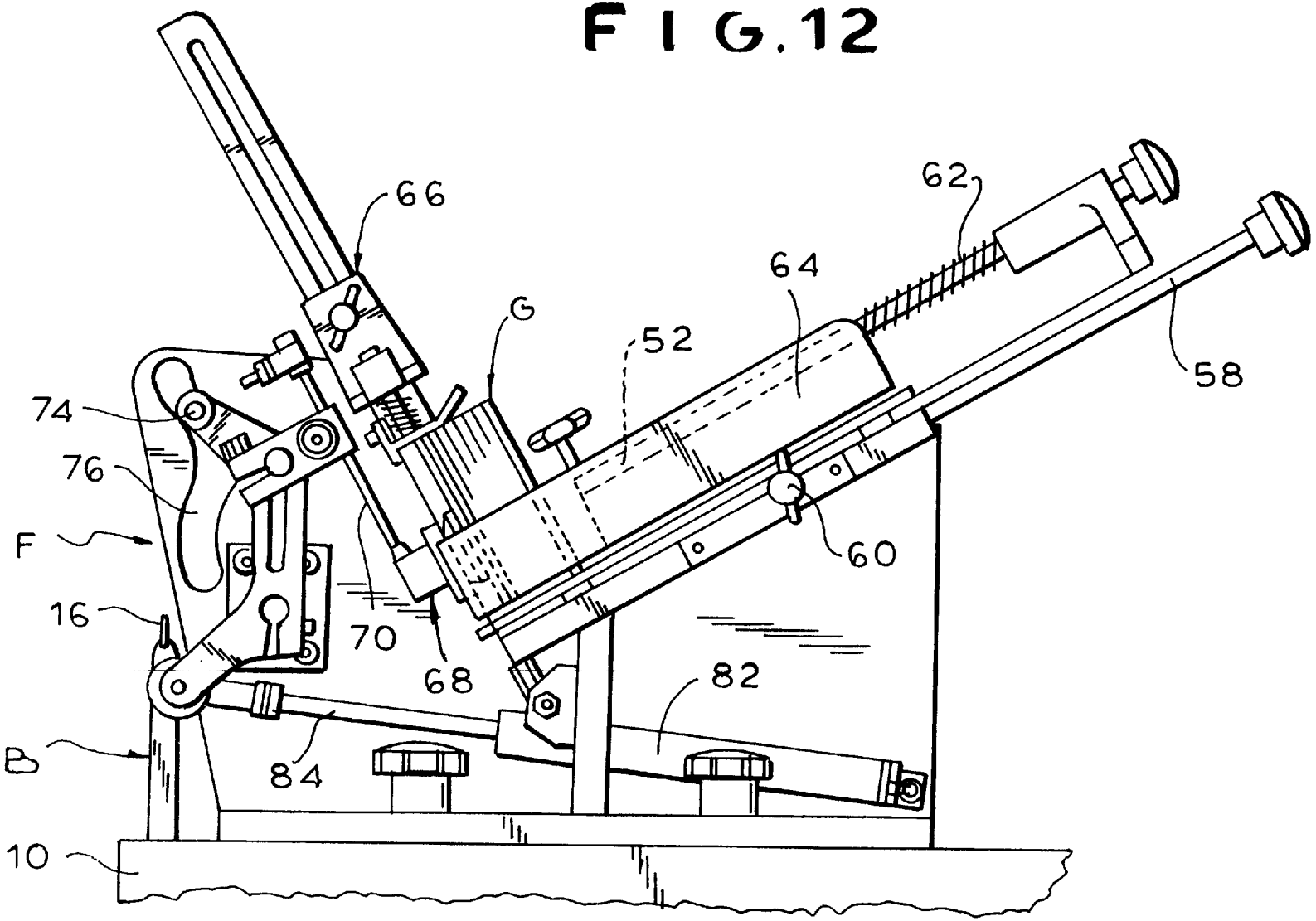
FIG. 12 is a side elevational view of the tag and/or hook feeder with the moveable suction arm in the engage position.
Figure 13:
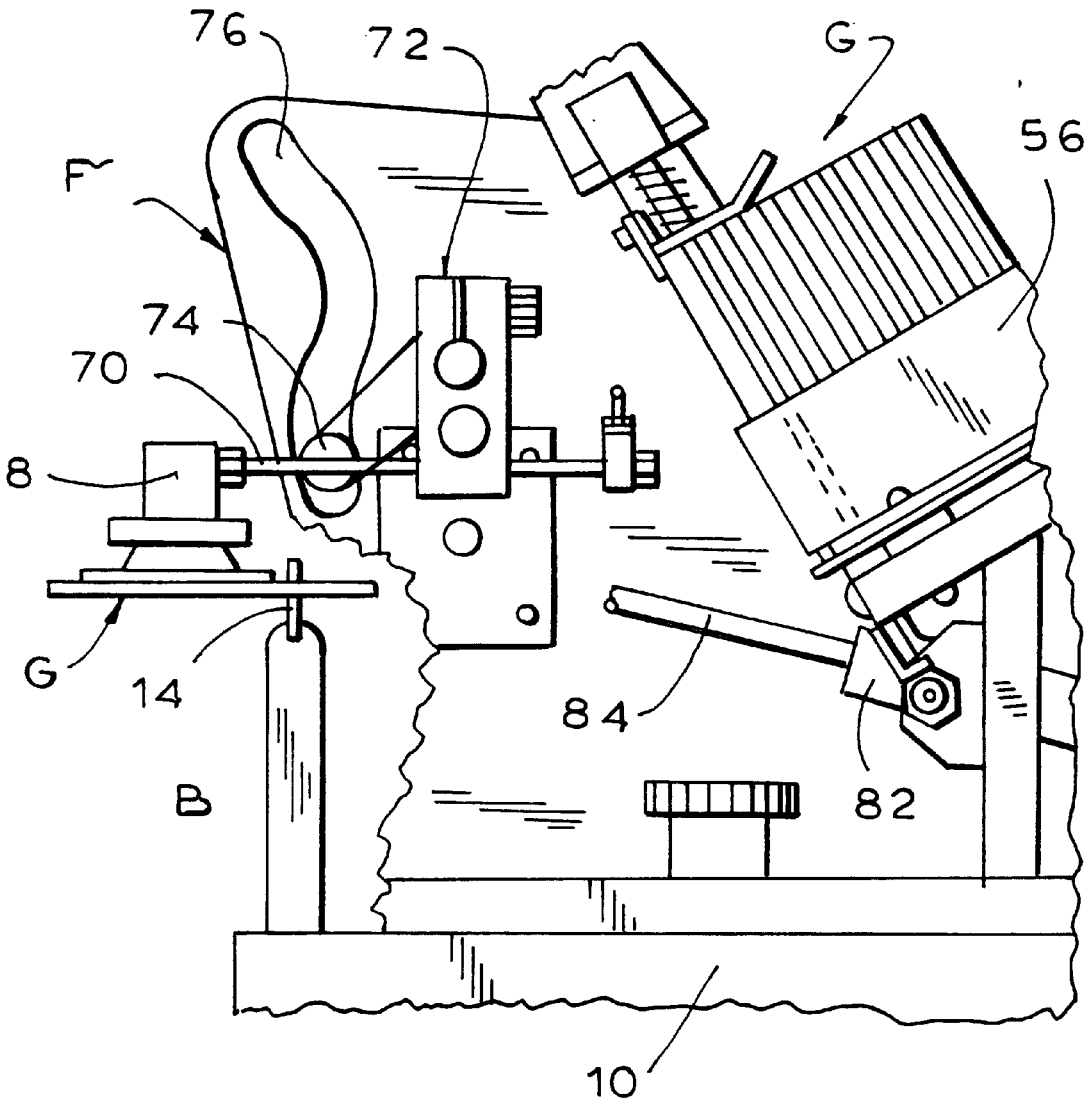
FIG. 13 is an enlarged view of the tag and/or hook feeder showing the suction arm in the discharge position.
Figure 14:
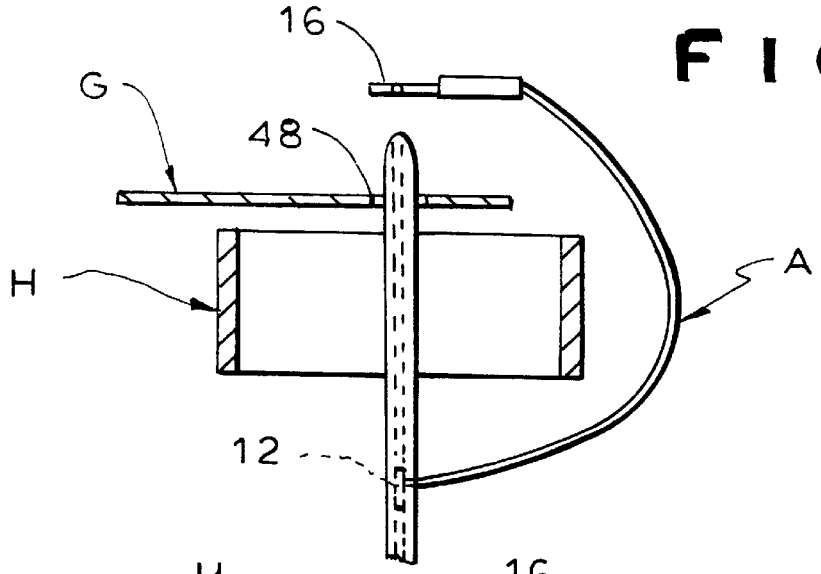
FIG. 14 is a schematic representation, viewed from above, showing the relative positions of the fastener, tag and article, prior to actuation of the apparatus.
Figure 15:
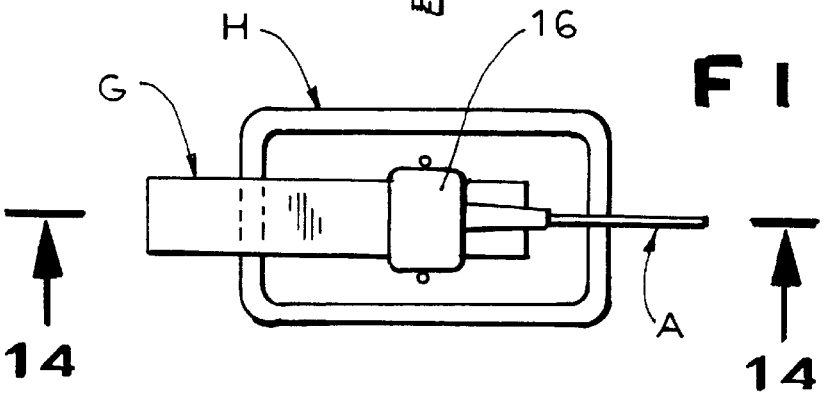
FIG. 15 is a side view, taken along line 15—15 of FIG. 14.
Figure 16:
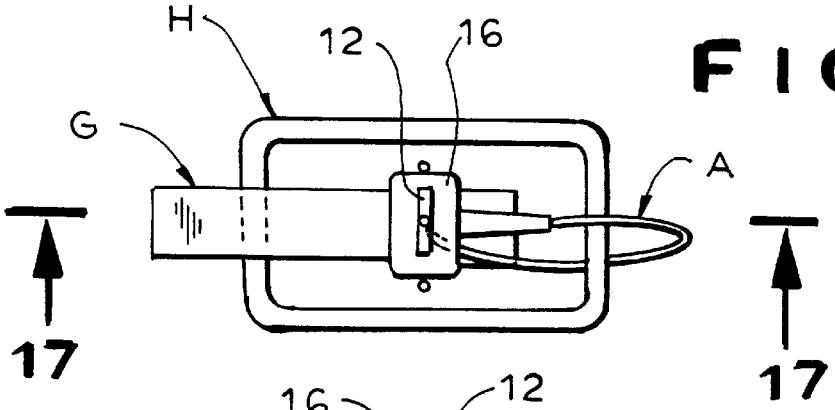
FIG. 16 is a view similar to FIG. 14, showing the fastener, tag, and article after the apparatus has been actuated.
Figure 17:
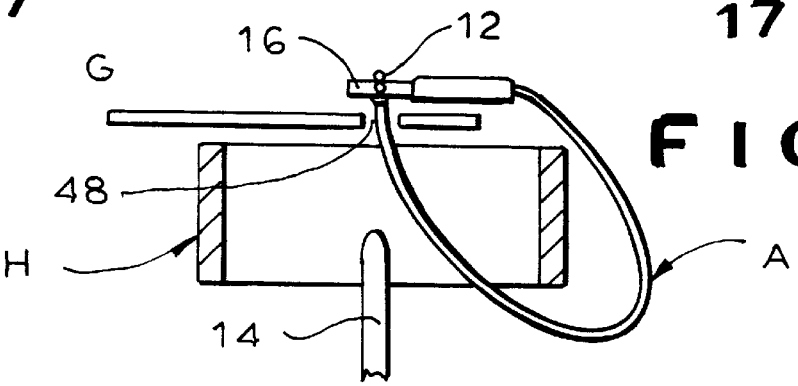
FIG. 17 is a side view, taken along line 17—17 of FIG. 14.

This apparatus is designed for use with an automatic tag or hook feeder, generally designated F, such as depicted in FIGS. 12 and 13 and disclosed in detail in U.S. Pat. No. 4,781,318 issued Nov. 1, 1988 to Ronald L. Meyers. Tags or plastic hooks, generally designated G, are retained in a stack 56. The tags or hooks are removed, one at a time, from the stack 56, which is located at a position remote from attacher B. The tags or hooks are moved to a position wherein the tag or hook is placed over the needle, with the opening 48 of the tag or hook receiving the needle.

Stack 56, which retains tags or hooks G, includes an adjustment rod 58 with a locking knob 60. A tension rod 62 positions side guides 60 to hold the tags or hooks. A hold down mechanism 66 serves to hold the remaining tags or hooks in the retainer as each is removed, one at a time, from the stack by a vacuum head 68.

Head 68 is attached to a moveable arm 70. Arm 70 is moved through a retangular path defined by an arm assembly 72 which includes a cam 74 which rides within a cam track 76, as indicated by numeral 80 on FIG. 2. The arm assembly is driven by a pneumatic cylinder 82 through rod 84 which is pivotally connected to the bottom of the assembly.

When actuated, the head engages the first tag or hook G on the stack, as seen in FIG. 12, by applying the vacuum to the suction cup. Cylinder 82 is then actuated to extend rod 84 and move the arm such that tag on hook G is placed over the needle 14, with the needle extending through the opening 48 in the tag or hook, as seen in FIG. 13. The arm then releases the tag or hook by venting the vacuum line and cylinder rod 84 retracts bringing the head into alignment with the next tag or hook in the stack.

If desirable, several tag on hook feeders can be used in tandem, placing multiple tags and/or hooks on the needle, as required. The tags and/or hooks are placed on the needle prior to the start of the cycle.

The sequence of steps in the method can best be understood by reference to FIGS. 14 through 17. First, with the tag or hook in place on the needle, the operator places the article, generally designed H, over needle 14 such that the needle extends through some opening or recess in the article. In the drawings, article H is shown as a generally rectangular hollow part but any article with an opening or recess can be tagged with this apparatus.

The size of the fastener (actually the length of the filament) is choosen such that it will form a loop of a size which is appropriate to the particular application and article. Larger size fasteners may be appropriate for larger articles but for articles like eyeglasses, where the loop is formed around the thin bridge between the lens pieces, a small filament may be required.

Once article H is in place between the filament and the needle, the operator actuates a foot pedal or other switch (not shown). The fastener A having been fed down guide track C, the "T" bar end 12 of the fastner is situated in "firing" position in attacher B and the paddle end 16 of the fastener is clamped in position in alignment with but above the needle 14. The filament of attachment A extends around a portion of article H, see FIGS. 16 and 15.

Anvil 36 is actuated to drive the clamped paddle end 16 down toward needle 14, causing the needle to penetrate paddle 16. At the end of the downward movement of anvil 36, attacher B is pneumatically actuated to eject the "T" bar end 12 of the fastener through needle 14 such that it lodges adjacent the top (far) surface of the paddle end 16, see FIGS. 16 and 17. The loop around article H is closed in this fashion, so as to affix the tag or hook G to the article.

Clamping mechanism E opens by pivoting arm 38 and anvil 36 retracts upwardly to its original position. Fastener moving means D is actuated to move claw 18 toward attacher B a distance equal to the width of one attachment to place the next paddle end 18 into position to be clamped, as attacher B feeds the next "T" bar end 12 into the firing position, in alignment with the rear of needle 14. Clamping mechanism E is then closed to clamp the paddle in retainer 39 on anvil 36.

The article H with the tag or hook is removed by the operator. The next tag or hook is fed over the needle by tag feeder F, article to be tagged on is placed over the needle and the operator actuates the switch to initiate the next operation.

It should now be appreciated that the present invention is an automatic tag attaching apparatus and method which employs standard plastic fasteners formed into loops to affix tags or hooks to articles having an opening or recess. It utilizes a conventional pneumatically driven attacher. A curved guide track or plow positions the paddle end of the fastener in a plane perpendicular to the axis of but remote from the needle, as the "T" bar end of the fastener is feed to the ejection position in the attacher. The paddle end is clamped to an anvil which drives the paddle end toward the needle such that the needle penetrates the paddle end. Actuating the attacher causes the "T" bar end to lodge on the far side of the paddle, securely closing the loop around the article.

While only a single preferred embodiment of the present invention has been disclosed herein for purposes of illustration, it is obvious that many variations on modifications could be made thereto. It is intended to cover all of these variations and modifications, which fall within the scope of the following claims:

We claim:

1. Automatic apparatus for forming a loop around an article with a fastener of the type having a "T" bar end and a paddle end connected by a flexible filament, the apparatus comprising a fastener attacher having a hollow needle and means when actuated, for ejecting the "T" bar end of the fastener through the needle, fastener feed means for providing the "T" bar end of the fastener to the attacher and positioning the paddle end of the fastener in alignment with, but spaced from the needle, said fastener feed means comprising a guide track with cooperating surfaces having a cross-sectional configuration which changes gradually from planar to semicircular, means for driving the paddle towards the needle such that the paddle is penetrated by the needle and means for actuating the attacher.

2. The apparatus of claim 1 for use with an article having an opening or recess defined in part by a portion, wherein the article is placed with said portion between the needle and the filament, prior to actuation of the driving means.

3. The apparatus of claim 1 further comprising means for feeding a tag or hook onto the needle.

4. The apparatus of claim 1 wherein said fastener feed means comprise means for engaging the fastener and for moving said fastener along said guide means.

5. The apparatus of claim 1 further comprising means for retaining the paddle end in alignment with the needle.

6. The apparatus of claim 5 further comprising means for clamping the paddle end.

7. The apparatus of claim 6 wherein said clamping means comprises a moveable arm.

8. The apparatus of claim 7 wherein said arm has an opening aligned with the needle.

9. The apparatus of claim 7 wherein said arm comprises first and second parts defining an opening.

10. The apparatus of claim 1 adapted for use with a strip of fasteners and wherein said fastener feed means comprises a claw, means for urging said claw to engage the fasteners and means for moving the claw in the direction of the attacher.

11. A method for forming a loop around an article with a fastener of the type having a "T" bar end and a solid paddle end connected by a flexible filament, using a fastener attacher having a hollow needle and which, when actuated, ejects the "T" bar end of the fastener through the needle, the method comprising the steps of feeding the fastener to provide the "T" bar end of the fastener to the attacher and positioning the paddle end of the fastener in alignment with, but spaced from, the needle; forming a semi-circular loop of filament between the paddle end of the fastener and the "T" bar end of the fastener; placing a portion of the article between the needle and the filament; forming an opening in the solid paddle end of the fastener by driving the paddle end and the needle towards each other such that the needle forms an opening in the solid paddle end as it penetrates the solid paddle end and driving the "T" bar end of the fastener through the needle and opening in the solid paddle end to form a loop around the article.

12. The method of claim 11 further comprising the step of feeding a tag or hook onto the needle.

13. The method of claim 11 adapted for use with a continuous strip of fasteners, wherein the step of feeding the fastener comprises the step of moving the strip of fasteners along a guide track.

14. The method of claim 11 further comprising the step of clamping the paddle end.

15. The method of claim 14 wherein the needle has an axis and wherein the step of clamping the paddle end comprises the step of clamping the paddle end in a plane substantially perpendicular to the needle axis.

16. The method of claim 14 wherein the step of clamping the paddle end comprises the step of pivoting a clamping arm.

17. The method of claim 16 wherein said clamping arm is pivoted prior to driving the paddle end.

18. Automatic apparatus for forming a loop around an article with a fastener of the type having a "T" bar end and a solid paddle end connected by a flexible filament, the apparatus comprising a fastener attacher having a hollow needle and which, when actuated, ejects the "T" bar end of the fastener through the needle, fastener feed means for providing the "T" bar end of the fastener to the attacher and positioning the paddle end of the fastener in alignment with, but spaced from the needle, means for forming an opening in said solid paddle end of the fastener by driving the paddle end and the needle towards each other, such that the needle forms an opening in the solid paddle end as it penetrates the paddle end and means for actuating said attacher.

19. The apparatus of claim 18 wherein said fastener feed means comprises a guide means.

20. The apparatus of claim 19 wherein said guide means comprises a track with a cross-sectional configuration which changes gradually from planar to semicircular.

* * * * *